US006388188B1

(12) United States Patent
Harrison

(10) Patent No.: US 6,388,188 B1
(45) Date of Patent: May 14, 2002

(54) ELECTRICAL CABLE AND METHOD OF MANUFACTURING THE SAME

(75) Inventor: Ian Harrison, Reading (GB)

(73) Assignee: Ixos Limited, Buckinghamshire (GB)

( * ) Notice: Subject to any disclaimer, the term of this patent is extended or adjusted under 35 U.S.C. 154(b) by 0 days.

(21) Appl. No.: 09/446,225

(22) PCT Filed: Jun. 15, 1998

(86) PCT No.: PCT/GB98/01739

§ 371 Date: Mar. 22, 2000

§ 102(e) Date: Mar. 22, 2000

(87) PCT Pub. No.: WO98/59349

PCT Pub. Date: Dec. 30, 1998

(30) Foreign Application Priority Data

Jun. 20, 1997 (GB) ..... 9713105
Nov. 27, 1997 (GB) ..... 9725147

(51) Int. Cl.[7] ..... H01B 11/02
(52) U.S. Cl. ..... 174/27; 174/113 C; 174/116
(58) Field of Search ..... 174/27, 36, 113 R, 174/113 C, 131 A, 116

(56) References Cited

U.S. PATENT DOCUMENTS 995,588 A * 6/1911 Cuntz ..... 174/27
5,313,020 A * 5/1994 Sackett ..... 174/113 C
5,428,189 A * 6/1995 Dorner et al. ..... 174/117 F
5,519,173 A * 5/1996 Newmoyer et al. ..... 174/113 R
5,831,210 A * 11/1998 Nugent ..... 174/27

FOREIGN PATENT DOCUMENTS

| | | |
|---|---|---|
| CH | 205 314 | 9/1939 |
| DE | 295 16 904 | 2/1996 |
| EP | 0104669 | 4/1984 |
| EP | 0256841 | 2/1988 |
| FR | 781 079 | 5/1935 |
| WO | WO 93/20563 | 10/1993 |

* cited by examiner

*Primary Examiner*—Chau N. Nguyen
(74) *Attorney, Agent, or Firm*—Nickolas E. Westman; Westman, Champlin & Kelly

(57) ABSTRACT

An electrical cable includes a second strand, and a third strand braided together. The first and second strands are electrically conductive and electrically insulated from each other, and the third strand is electrically non-conductive. The geometry imparted to the conductive strands by the braided configuration results in the cable exhibiting improved noise rejection, lower inductance per unit length, reduced signal attenuation and reduced resistance compared with cables having twisted or parallel pairs of conductive strands. The cable is particularly suited to audio, video and computer applications. Cables that have larger numbers of strands braided together, and multilayer cables are also described.

55 Claims, 14 Drawing Sheets

PROJECTION OF PATH OF STRAND 1 ON PLANE ⊥'r TO LONGITUDINAL AXIS (SCHEMATIC)

(a)

(b)

PROJECTION OF PATH OF STRANDS (a)

(b)

PROJECTION OF STRAND PATHS.

CABLE A

CABLE B
PRIOR ART

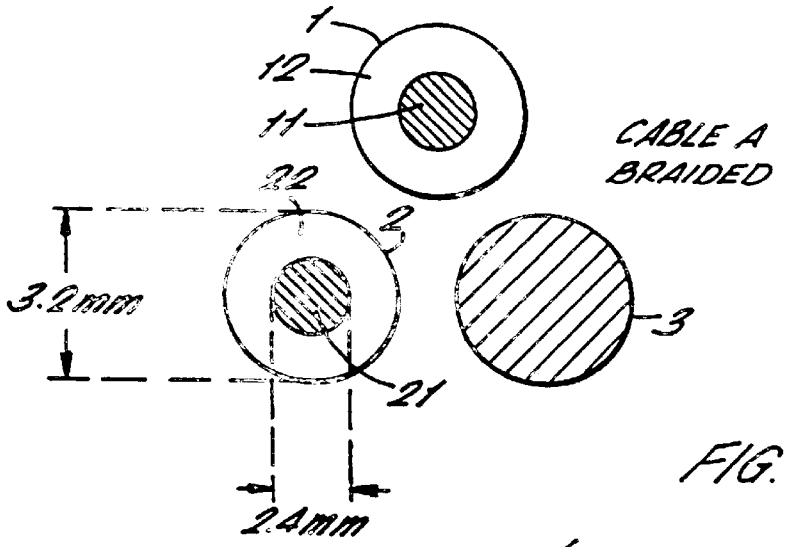
FIG. 12.
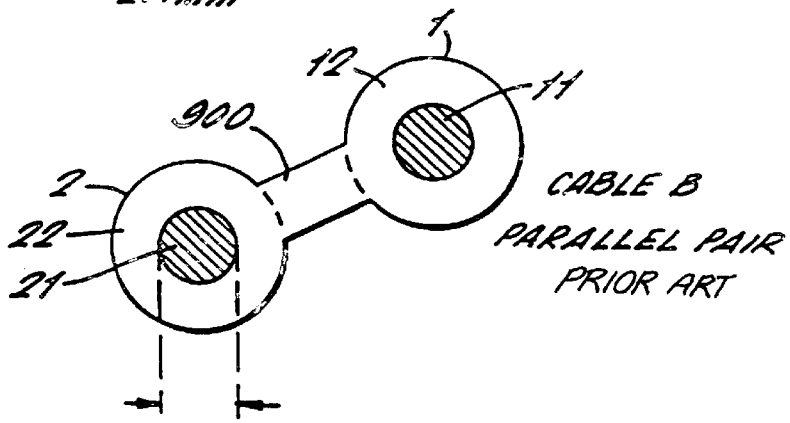
FIG. 13.
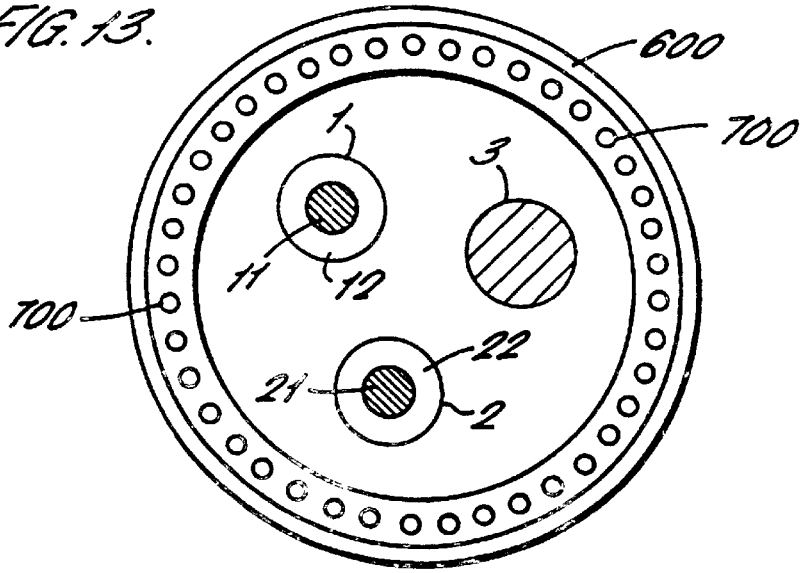

BIWIRING

TRI-WIRING

FIG. 15.
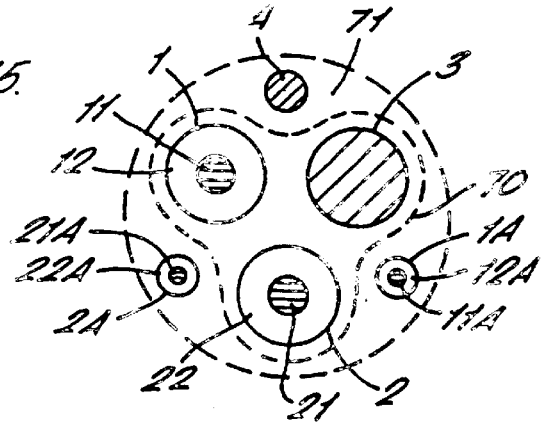
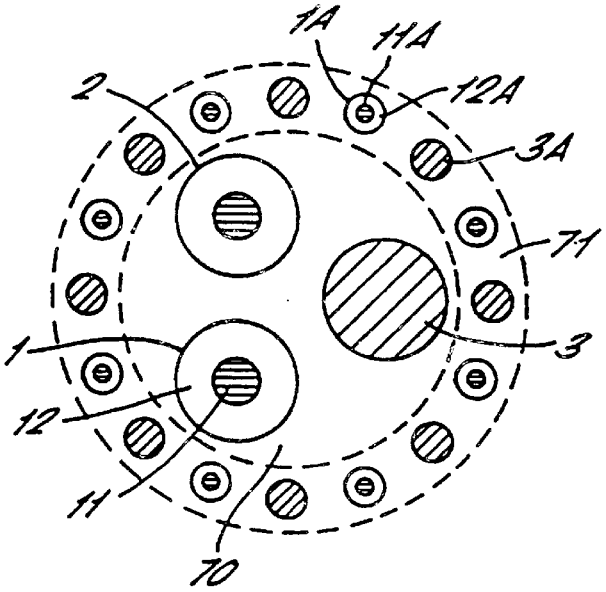
FIG. 16.
FIG. 18.
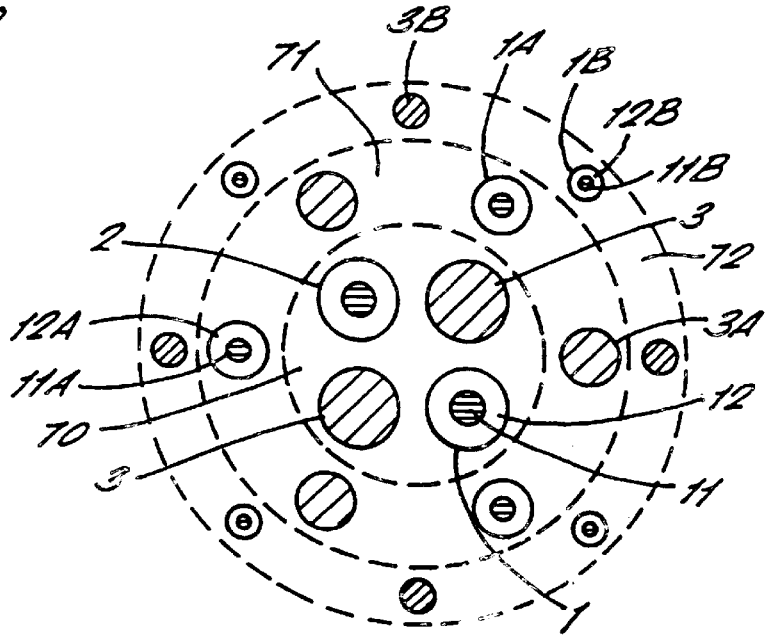

ELECTRICAL CABLE AND METHOD OF MANUFACTURING THE SAME

This application claims priority under 35 U.S.C. § 119 of PCT Application No. PCT/GB98/01793, filed Jun. 15, 1998, and Great Britain Patent application No. GB9713105.6, filed Jun. 20, 1997, and Great Britain Patent Application No. GB 9725147.4, filed Nov. 27, 1997, the PCT application having been published as International Publication WO 98/59349 in English.

BACKGROUND OF THE INVENTION

The present invention relates in general to electric cables, and in particular, although not exclusively, to electric cables for audio, hi-fi, video or computer applications.

It is a well-known technique to twist a pair of wires carrying an electrical signal to improve the noise rejection of the pair.

For computer applications, such as connecting peripherals to interface card, cables are known which comprise adjacent sets of twisted pairs, each pair consisting of one signal line and one ground wire. One configuration of such a cable is a ribbon-like flat cable in which there are flat untwisted regions at regular intervals along the cable for easy connection to crip-on connectors of the type used for ordinary ribbon cable. Because of the strobed data transfer protocol used on computer buses and in connections to peripherals, it generally is not necessary to use twisted pairs for all signal lines, instead just for the synchronising pulses and other strobing or enabling lines.

In audio systems applications it is a well-known technique to twist the pairs of conductors carrying differential signals in interconnecting leads (between for example the CD player and amplifier) and in speaker cables to improve the noise rejection of the cables. Spurious RF signals which would degrade the sound quality are rejected by the twisted geometry. In the case of speaker cables, it becomes particularly desirable to twist pairs of wires carrying the signals for each channel when the total cable length is great.

A variety of known audio cable geometries are shown in FIG. 1. In FIG. 1(*a*), two insulated wires 1, 2 with conductive cores 11, 21 are twisted together and encased in a flexible dielectric jacket 6. FIG. 1(*b*) shows a known geometry comprising two wires twisted together with a non-conductive strand 3, and FIG. 1(*c*) shows the cross section of a known geometry comprising two wires 1,2 twisted together with two non-conductive strands 3, 3*a*.

In general, the greater the twist (i.e. the greater the number of twists per unit length) the greater the noise rejection property of the cable. However, as the number of twists per unit length is increased, there comes a point when the cable has a strong tendency to bunch even under tension, and once released from the spool on which it has been wound it becomes unmanageable. This has been referred to as the "elastic band" effect.

Partly for this reason, in the audio cable industry a twist frequency of 5 per inch has been seen as the benchmark for cables comprising twisted jacketed (i.e. insulated) conductors. It is a compromise figure, giving good noise rejection in conjunction with ease of manufacture.

SUMMARY OF THE INVENTION

It is an object of the present invention to provide an electrical cable which overcomes some of the problems associated with the prior art.

It is a further object of the present invention to provide an improved method of manufacturing an electrical cable.

According to a first aspect of the present invention there is provided an electrical cable comprising a first strand, a second strand, and a third strand, wherein said first and second strands are electrically conductive and electrically insulated from each other, said third strand is electrically non-conductive, and said first, second, and third strands are braided together.

Advantages of a cable in accordance with this first aspect of the present invention are numerous, and include:

1. The inductance per unit length of the cable is lower than that of a cable comprising the same conductive strands but in a twisted pair configuration (with the same crossover frequency). The "braided" geometry reduces the self inductances of the individual conductive strands.

2. The noise rejection of the cable is significantly better than that of an equivalent twisted pair. In particular the "braided" cable, whilst performing similarly to the twisted pair at rejecting noise caused by fluctuations in the component of background magnetic field transverse to the cable, is intrinsically better at rejecting noise caused by fluctuations in the longitudinal component.

3. The "braided" geometry can lead to significant reductions in the attenuation of signals along the cable compared with the twisted pair.

4. Braided cables in accordance with the present invention may exhibit lower resistance than equivalent cables comprising the same conductive strands but in the form of twisted or parallel pairs. This reduced resistance is due to reduced interaction between the adjacent "go" and "return" currents in a pair of conductive strands used to carry a differential signal, or, in other applications ac or dc power.

The "go" and "return" currents are moving in opposite directions and electromagnetic interaction between them distorts the current distributions in each conductive strand. This reduces the effective cross sectional area of the conductive part of the strand and so results in an increase in resistance. It should be noted that this is a real increase in the resistance of the cable, separate from any increase in the magnitude of the impedance of the cable due to any increase in its self inductance which may also result from changes in current distributions.

In a twisted pair or a closely spaced parallel pair the conductive strands carrying the "go" and "return" currents are in close proximity to each other along their entire lengths. The interaction between these currents is therefore strong, and results in increased resistance.

In contrast, in the inventive braided cables, the is conductive strands are repeatedly separated along the length of the cable by the non-conductive strand (or strands). This reduces the interaction between the go and return currents and so reduces any resultant resistance increase.

The thickness of the non-conductive strand or strands may result in a repeated spacing of the conductive strands between their "crossover" points that is sufficiently large to make resistance increases due to inter-strand interaction negligible, or even zero.

In a parallel or twisted pair arrangement, the separation of the conductive strands can be increased to reduce inter-strand interaction, but results in increased inductance and susceptibility to noise.

The inventive braided cables reduce inter-strand interaction, resulting in reduced cable resistance, whilst retaining low inductance geometry and improved noise rejection.

Interaction between adjacent "go" and "return" currents in cables has also been termed "the proximity effect", and for ac signals has been seen to result in increases in cable resistance with frequency. In contrast to twisted or parallel pairs, the inventive braided cables may render such resistance increases negligible, or even zero, for signal frequencies of interest (e.g. up to 20 KHz for audio applications).

In general, the proximity effect is more significant for low-resistance cables (i.e. incorporating heavier guage conductors) such as speaker cables, as lateral current mobility, which enables distortion of the current profile in the conductor, is greater. With larger diameter conductors, there is greater scope for current distribution distortion. Thus, in audio applications, the resistance reducing aspect of the inventive braided cables is particularly advantageous in speaker cables.

The strands may be encased in a flexible jacket of dielectric material. This jacket may comprise one or more materials from a list including PTFE, PE, and PVC, and may be a composite. Of course, a wide variety of other materials may be used.

As a result of the "braided" geometry lowering the self inductance of the cable, increased capacitance can be tolerated. Thus the cable designer has a wider choice of materials to use for the jacket, and so has more freedom to tailor the LCR properties of the cable to the particular application. For audio cables, the designer thus has more freedom to alter the "sound" of the cable.

Also, because higher cable capacitances can be tolerated, less expensive materials can be used for the jacket.

For certain applications, the jacket may be substantially non-flexible. For example, it may be desirable to prevent movement of the strands to reduce noise to a minimum.

The "braided" geometry also enables excellent levels of noise rejection to be achieved without the use of screening foils or braids, and so simplifies cable manufacture and reduces costs.

Of course, if screening means are incorporated, the noise rejection of the cable car, be improved still further.

The cable comprising three braided strands is more flexible than a cable comprising similar strands twisted together.

Also, a greater number of transpositions, or crossovers, of the two conductive strands can be achieved per unit length compared with a twisted geometry, without the cable becoming unmanageable, i.e., the "elastic band" problem is largely alleviated. Getting around the elastic band problem greatly improves the ease of manufacture of the cable, and by enabling the crossover frequency per unit length of the conductive strands used to carry electrical signals to be increased, the braided geometry can lead to improved noise rejection.

Even with the same crossover frequency per unit length, the braided cable of two conductive strands and a non-conductive strand can exhibit improved noise rejection over a cable comprising the same strands twisted together.

For a given crossover frequency, in the braided geometry the two conductive strands cross each other at a larger angle (i.e. closer to 90°)than do the conductive strands in a twisted pair configuration. This may contribute to the improved noise rejection of the cable.

Advantageously, the crossover frequency may be in the range 1 to 100 per meter. Of course, alternative crossover frequencies may be employed, and in cables comprising a plurality of groups of braided strands, the strands of one group may be braided with a different crossover frequency to those in another group.

By braiding the strands rather than twisting them, the inductance per unit length of the cable can be reduced, as can the attenuation of signals transmitted along the conductive strands.

By enabling reductions to be made in both the self inductance of the cable and the attenuation of signals, the braided geometry also enables the cable designer to have a greater level of control over the LCR properties of the finished design. For example, different insulating materials may be used which would, in a twisted geometry, lead to unacceptably high values of cable capacitance. However, by reducing L, increases in capacitance may be tolerated. In the case of audio cables, the design therefore has a greater degree of control over the "sound" of the cable, in particular a greater degree of control over the signal phasing. For cables predominantly carrying power, the designer has a greater degree of flexibility over the current flow. In addition, by giving the cable designer a wider choice of dielectric materials, the braided geometry enables cheaper materials to be used to lower the cost of the cable whilst retaining satisfactory performance.

By braiding the strands rather than twisting them the shape of the surface bounded by the two conductive strands is greatly altered. The fundamental difference between the shapes of these surfaces corresponding to the two geometries leads to the improved noise rejection of the inventive cable.

The braided geometry is well suited to flat ribbon-like cables comprising a plurality of strands. Advantageously such cables may be used in computer applications.

A cable comprising three braided conductive strands could of course have the same geometry as an embodiment the present invention, and indeed such cables are known, and used for example as interconnects in hi-fi applications. One of the conductive strands could be left unconnected, while the other two were used to carry signals. This arrangement might be expected to show similar characteristics to the cable in accordance with an embodiment of the present invention. However, in cables according to the present invention, using a non-conductive third strand enables considerable savings in cost to be made. This is true for many embodiments of the present invention but is particularly important when expensive, high conductivity materials are used in the conductive strands, especially when these conductive strands are heavy gauge wires. In addition, use of a non-conductive third strand enables the weight of the cable per unit length to be reduced. Furthermore, by incorporating a third strand comprised entirely of dielectric material, rather than using, say, a conductive strand in the form of a wire with an outer sheath of dielectric around a conductive (but unused ,i.e., unconnected) core, an increased amount of dielectric material can be incorporated in the cables cross section. This is yet another factor which gives the designer greater control over the electrical properties of the cable.

Advantageously, the third strand may comprise PTFE, PE, or PVC, but it will be apparent that a wide variety of alternative materials may be used. The third strand may be a composite.

The third strand and the flexible jacket may comprise the same dielectric material, and may be substantially integral, i.e. the boundary between the third strand and the jacket may be indiscernible for at least part of its length.

Advantageously, insulation of the first and second conductive strands may be achieved by using a first strand comprising a conductive core with an outer sheath or coating of dielectric material. In this case, the second strand may not require separate insulation, and could be a bare strand of conductive material.

Alternatively the second conductive strand may also have a dielectric sheath.

It will be apparent that the first, second and third strands may, independently, have many different configurations, and all combinations are possible.

For example, the conductive strands may comprise a single conductive filament or a plurality of conductive filaments, formed from a variety of materials including copper, oxygen-free copper (OFC), silver, pure silver, gold and conductive carbon fibre. Of course this list is not exhaustive, and a wide variety of other materials may be employed. Advantageously, the filaments may be coated or plated, for example with silver or gold.

The conductive strands may comprise a conductive core inside a dielectric sheath, and this sheath may comprise polytetrafluoroethylene (PTFE), polyethylene (PE), polyvinylchloride (PVC) or any other suitable material. The sheath may be a composite.

The conductive strands may be round wires, or alternatively tapes or wires with other cross sections.

The non-conductive strand may be comprised of a single dielectric material or may be a composite of at least two dielectrics. Suitable dielectrics include PTFE, PE and PVC which may be chosen to give desired cable characteristics. A material may be chosen to given a cable with increased capacitance per unit length. Again, the third strand may be round, or alternatively have a different cross section.

By "non-conductive" it is meant that the third strand is incapable of carrying an electrical current from one end to the other. It may be comprised entirely of dielectric material, or alternatively may have regions of conductive material embedded in it, electrically insulated from each other, but capable of affecting the LCR characteristics of the cable.

The cable may be a cable of twenty-five strands, and may be in the form of a ribbon cable for computer applications.

All three strands may be round and have the same diameter, giving a symmetrical uniform cable, or alternatively at least two of the strands may have different diameters. Thus it will be apparent that strands may independently have a variety of cross sections and sizes.

Advantageously the cross sectional areas of the conductive components of the first and second conductive strands may be the same, or the second strand may have a reduced conductive cross section. This may act as a choke in the "return" wire of a speaker cable to give desired sound quality.

Advantageously, the three strands may be encased in a dielectric jacket.

Advantageously, a cable may comprise two sets of strands, each set comprising three strands braided together where one of the strands in each set is non conductive. The two sets of strands may be twisted together, with or without filler material, and encased in an outer sheath.

Shielding means may be incorporated in the cables to improve noise rejection, and may, for example, be in the form of a foil or an outer braid of conductive filaments.

Advantageously, cables in accordance with embodiments of the present invention may comprise an inner section (i.e. "core") of conductive and non-conductive strands braided together, surrounded by one or more braided sleeves. The braided sleeves may comprise two or more electrically conductive strands and may be used to carry signals different from those carried by the inner section.

A surrounding braided sleeve may comprise conductive and non-conductive strands braided together, or just conductive strands, or just non-conductive strands.

Cables in accordance with aspects of the present invention may be used to connect various electrical devices, for example in audio, hi-fi, video and computer systems, and combinations thereof.

According to a second aspect of the present invention there is provided a method of manufacturing an electrical cable comprising the steps of braiding together a first conductive strand, a second conductive strand and a non-conductive strand, and electrically insulating said first and second strands from each other.

Embodiments of the present invention will now be

BRIEF DESCRIPTION OF THE DRAWINGS

FIG. 12 is a schematic diagram of the cross sections of the cables whose performance characteristics are given in Table 2 of the description;

FIG. 13 is a schematic diagram of the cross section of an embodiment of the present invention incorporating screening means;

FIG. 15 is a schematic cross section of an embodiment of the present invention;

FIG. 16 is a schematic cross section of an embodiment of the present invention;

FIG. 18 is a schematic diagram of a multi-layered embodiment of the present invention;

DETAILED DESCRIPTION OF THE INVENTION

Figure 1:
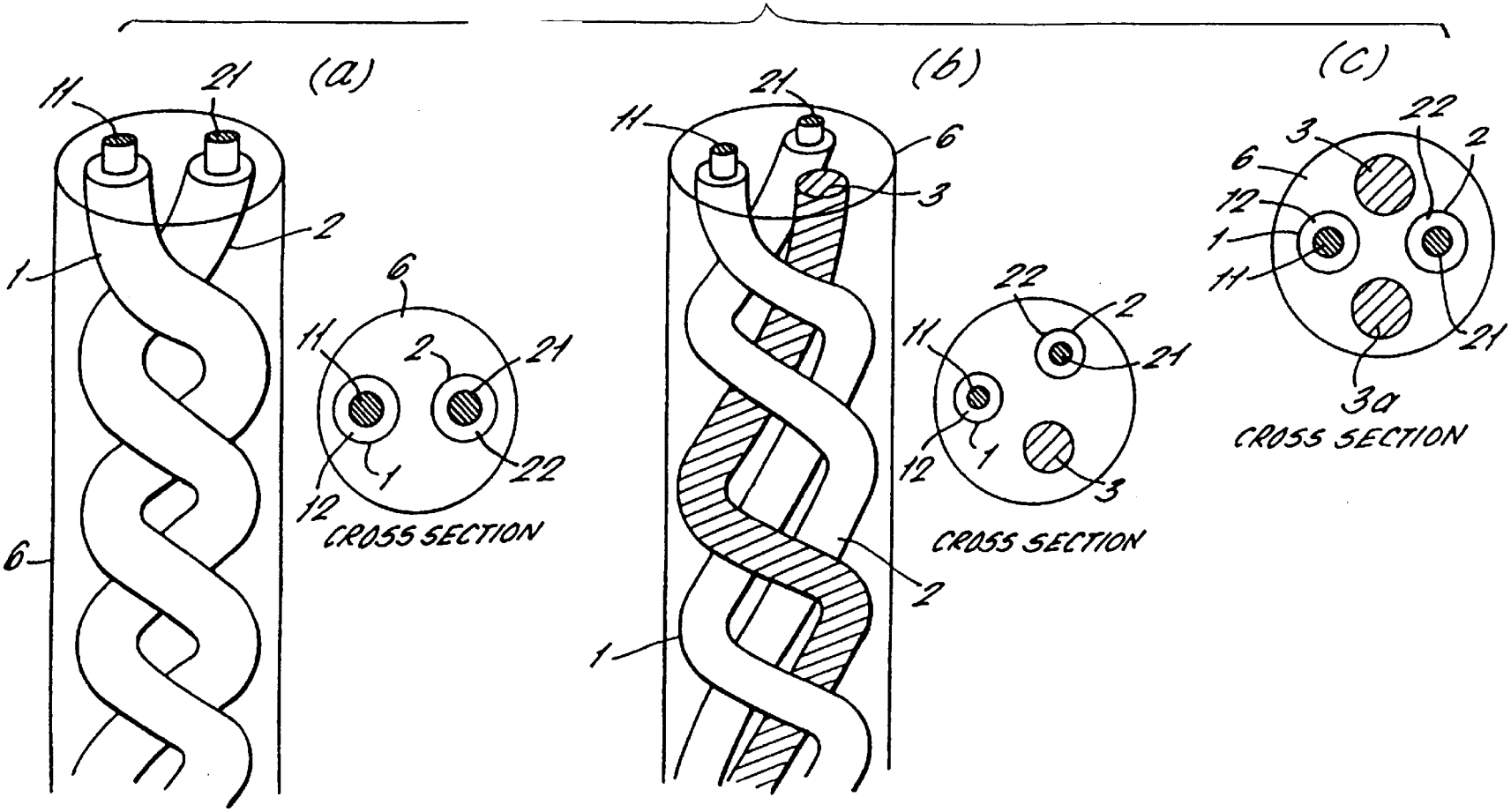
FIG. 1. PRIOR ART
FIG. 1 is a schematic diagram of some known audio cable geometries.
Figure 2:
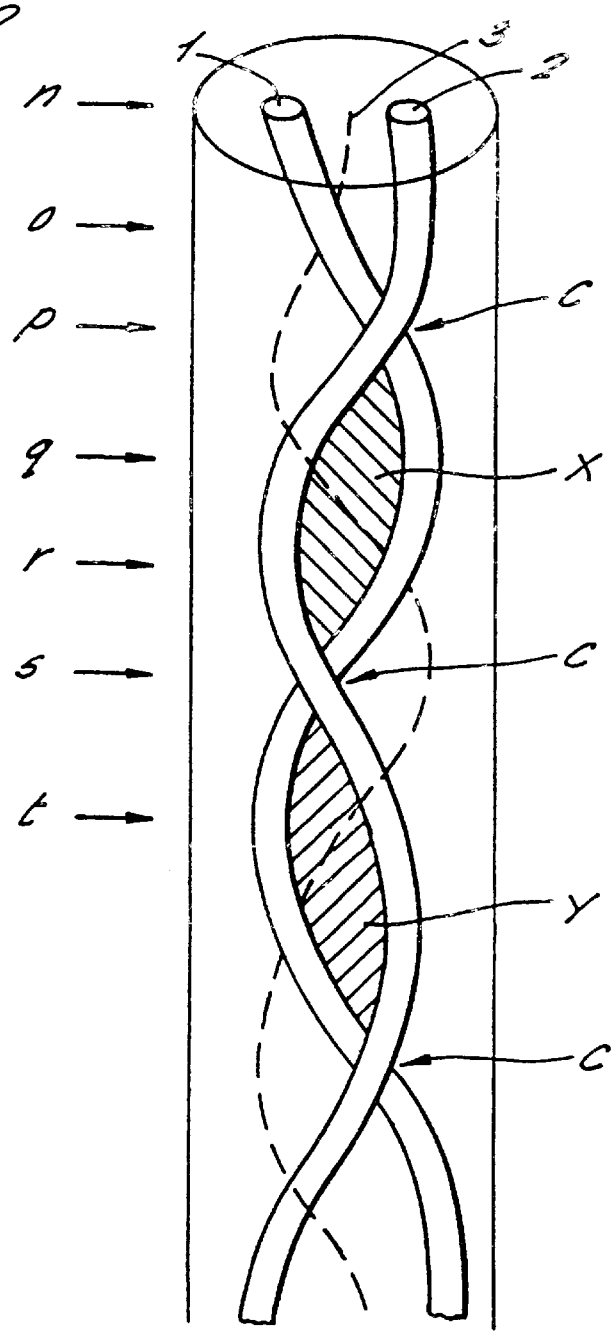
FIG. 2 is a schematic diagram of an electrical cable in accordance with an embodiment of the present invention.
Figure 2:
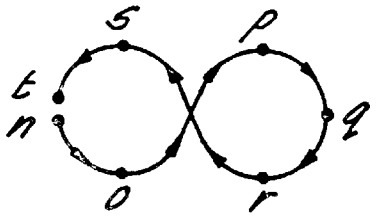

Referring now to FIG. 2, an embodiment of the present invention comprises two conductive strands 1, 2 embedded in a jacket 6 of flexible dielectric material comprising a third non-conductive strand 3, shown as a broken line. The three strands 1, 2, 3 are intertwined and braided together. The third strand 3 is comprised of the same material as the jacket 6, and the third strand 3 and jacket 6 are integral, i.e. they are indistinguishable.

Looking into the page, successive loops of the two strands enclose equal and opposite areas X,Y. Thus, this geometry will reduce the noise voltage generated by fluctuations in the component of background magnetic field normal to the page in the same way as a twisted pair of wires.

Unlike a twisted pair, however it can be seen from the figure that each time the two strands cross (see positions C), it is always the same strand 2 which cross on top. The strands do not follow uniform helices, and the surface bounded by the two wires does not undergo continuous and uniform rotation in one direction.

Instead, the projection of the path of each strand on the plain perpendicular to the longitudinal axis of the cable approximates to a figure of eight.

In other embodiments, the "figure of eight" may have additional structure or detail, depending on the exact way in which the braid was manufactured.

A schematic diagram of the projection of the path of the first strand 1 is shown in the figure, with the positions of the strand at various points along the length of the cable labelled n to t.

The projection of the path of the second strand 2 has exactly the same shape, but the phase difference between the positions of the two strands on the figure of eight at any point along the cables length is 120°.

This braided geometry results in improved noise reduction and reduced inductance per unit length, as will be understood from the following description.

Figure 3:
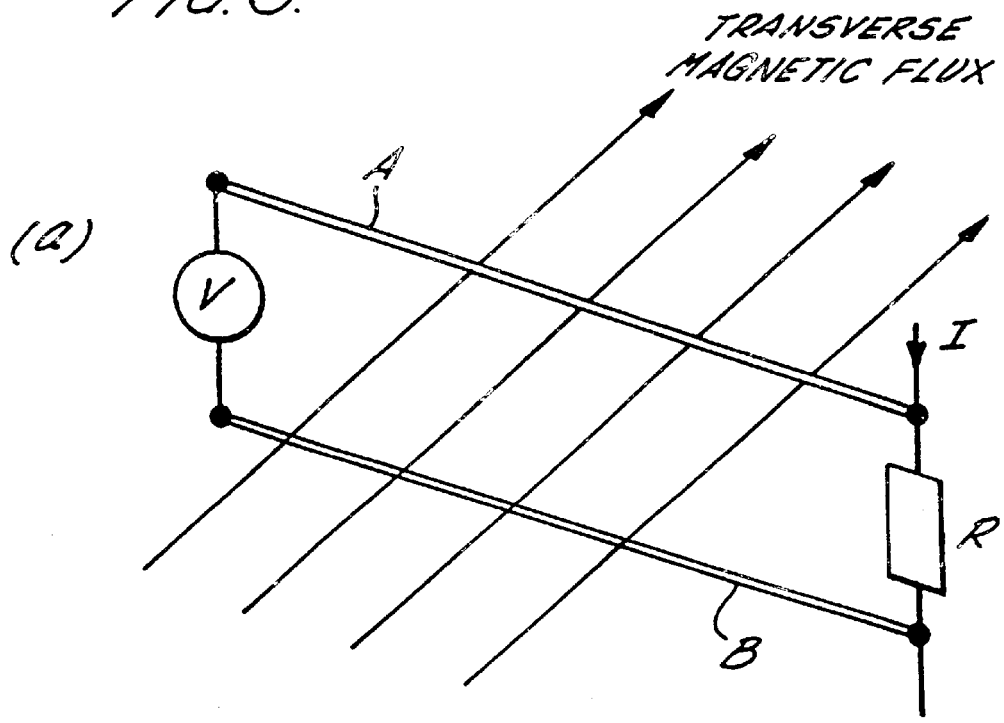
FIG. 3 shows schematic diagrams of two measurement circuits illustrating the beneficial effect of twisting signal wires.
Figure 3:
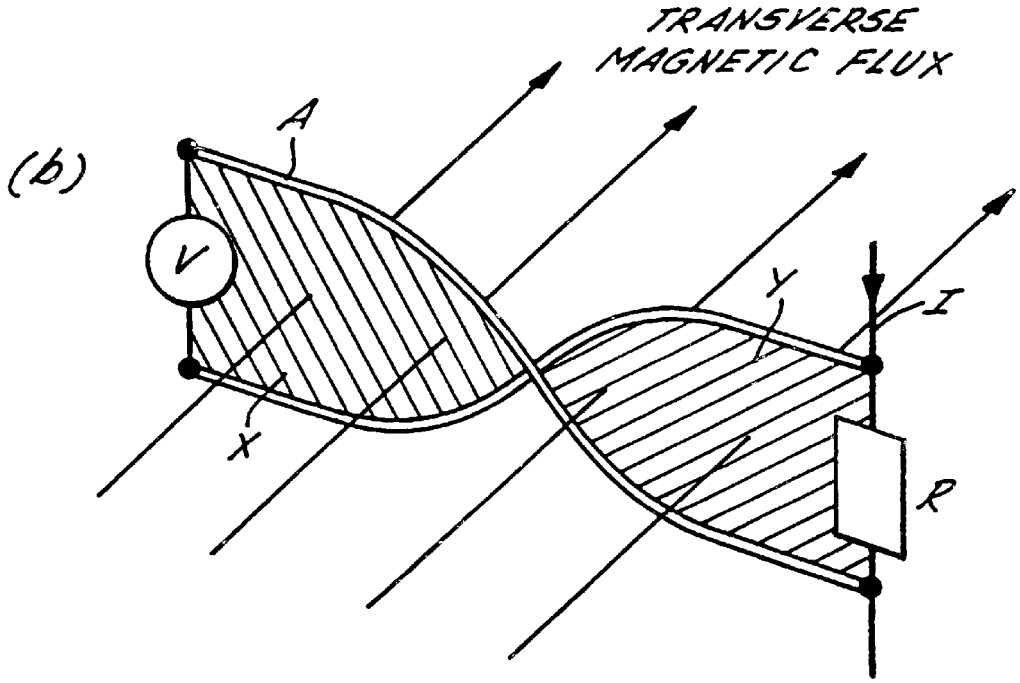

Consider the circuit shown in FIG. 3(*a*). An untwisted pair of wires A and B connect a volt meter to a resistor R to enable the voltmeter to measure the voltage developed across the resistor. A spatially uniform background magnetic field is present, having a component transverse to the measurement circuit, and a quantity $\Phi$ of magnetic flux links the measurement circuit. If the background magnetic flux density changes with time, then the amount of flux linking the circuit will change also, and a noise voltage equal to $d\Phi/dt$ will appear on the signal i.e. the voltage measured by the voltmeter.

In contrast, in the arrangement shown in FIG. 3(*b*) a half twist has been made in the pair of wires at their midpoint, forming two loops (X and Y) of substantially the same area. The quantities of magnetic flux linking these two "loops" are the same, but they link the measurement circuit (i.e. the surface bounded by the voltmeter, the two wires, and the resistor) in opposite directions. Therefore, the total transverse flux linking the measurement circuit is substantially zero and fluctuations in background field will not result in noise on the voltage signal.

In the case of a spatially non uniform background field, the total flux linking the twisted measurement circuit may be non-zero, but if the change in field with time is everywhere the same, $d\Phi/dt$ will still be zero and no noise voltage will result. However, if the temporal variation in background field is spatially dependent, the changes in flux linking the two loops may not be the same.

It is therefore desirable to increase the number of twists per unit length in the wires to subdivide further the region over which electromagnetic fluctuations may occur, and ensure that the changes in transverse magnetic flux linking adjacent loops are substantially the same.

So, twisting the wires reduces noise caused by variations in the transverse component of magnetic field, and the more twists the better. Unfortunately, however, with regard to the longitudinal component of magnetic field, twisting the wires makes matters worse.

When the conductors are straight and untwisted the measurement circuit presents negligible area to longitudinal flux, and so fluctuations in that flux will not induce significant noise voltages.

Figure 4:
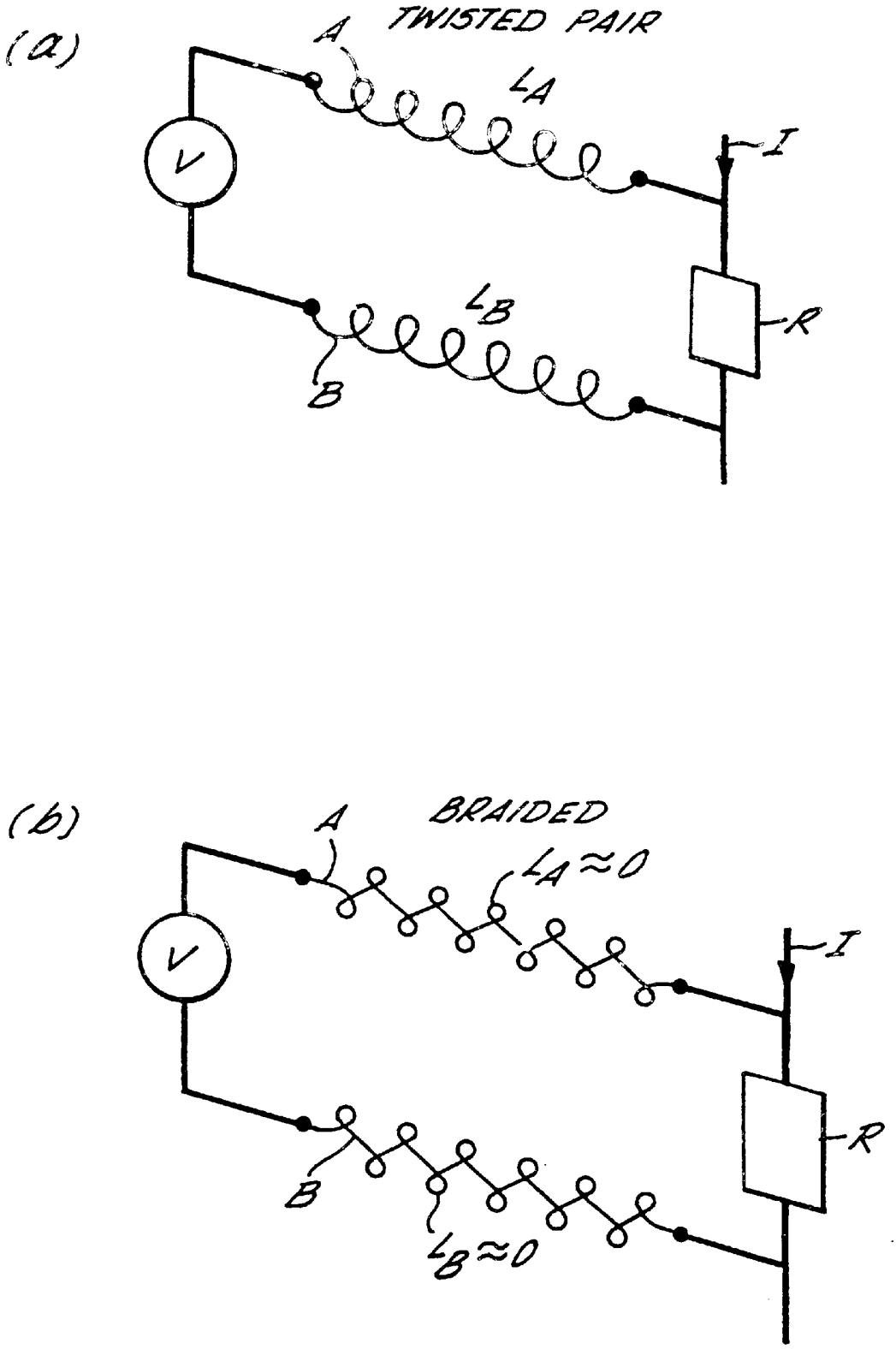
FIG. 4 is a schematic diagram of measurement circuits illustrating the improved geometry of a cable in accordance with the present invention.

When the pair is twisted however, each wire becomes a coil, and any variations in longitudinal flux will now lead to noise voltages being developed in each coil. A schematic diagram of a circuit comprising a twisted pair of wires is shown in FIG. 4(*a*). The two wires are represented as inductors $L_A$ and $L_B$. Only if the changes in flux linking the two coils are exactly the same will the induced voltages exactly cancel.

The two coils do not of course occupy exactly the same region of space; they are nested, and localised fluctuations in the longitudinal component of background magnetic field may alter the flux linking one of the coils more than that linking the other.

Increasing the number of turns per unit length does not help matters. The same noise voltage is developed if a change in flux links two turns of wire A and one turn of wire B, or 200 turns of wire A and 199 of wire B.

In contrast, in embodiments of the present invention where the two wires are arranged as if braided with a third strand, each wire follows a figure of eight path along the cable, rather than a helix. Such a cable is shown schematically in FIG. 4(*b*). Each wire therefore has an essentially non-inductive geometry and variations in the longitudinal component of background field induced negligible noise voltages in each lead.

Thus, in the twisted pair arrangement, rejection of noise resulting frog fluctuations in longitudinal magnetic flux was reliant on the voltages induced in the inductively wound leads cancelling exactly.

The "braided" geometry improves the rejection of such noise by first reducing the voltages induced in each lead to a minimum.

The braided geometry improves the overall noise rejection of the cable by reducing the self indutancies of the component conductive strands. They do not follow helical paths but instead, in the case of a three wire braid, follow substantially a figure of eight. The areas of the two lobes, or loops, of the figure of eight have equal and opposite areas. The braided geometry thus provides the same rejection of noise from fluctuations in the transverse component of magnetic field as a twisted pair, but dramatically improved rejection of noise from fluctuations in the longitudinal component, by reducing the self inductances of the individual wires to values close to those of straight wires.

The braided geometry combines the transverse magnetic field noise rejection of the twisted pair with the longitudinal magnetic field noise rejection of the straight wire cable.

Figure 5:
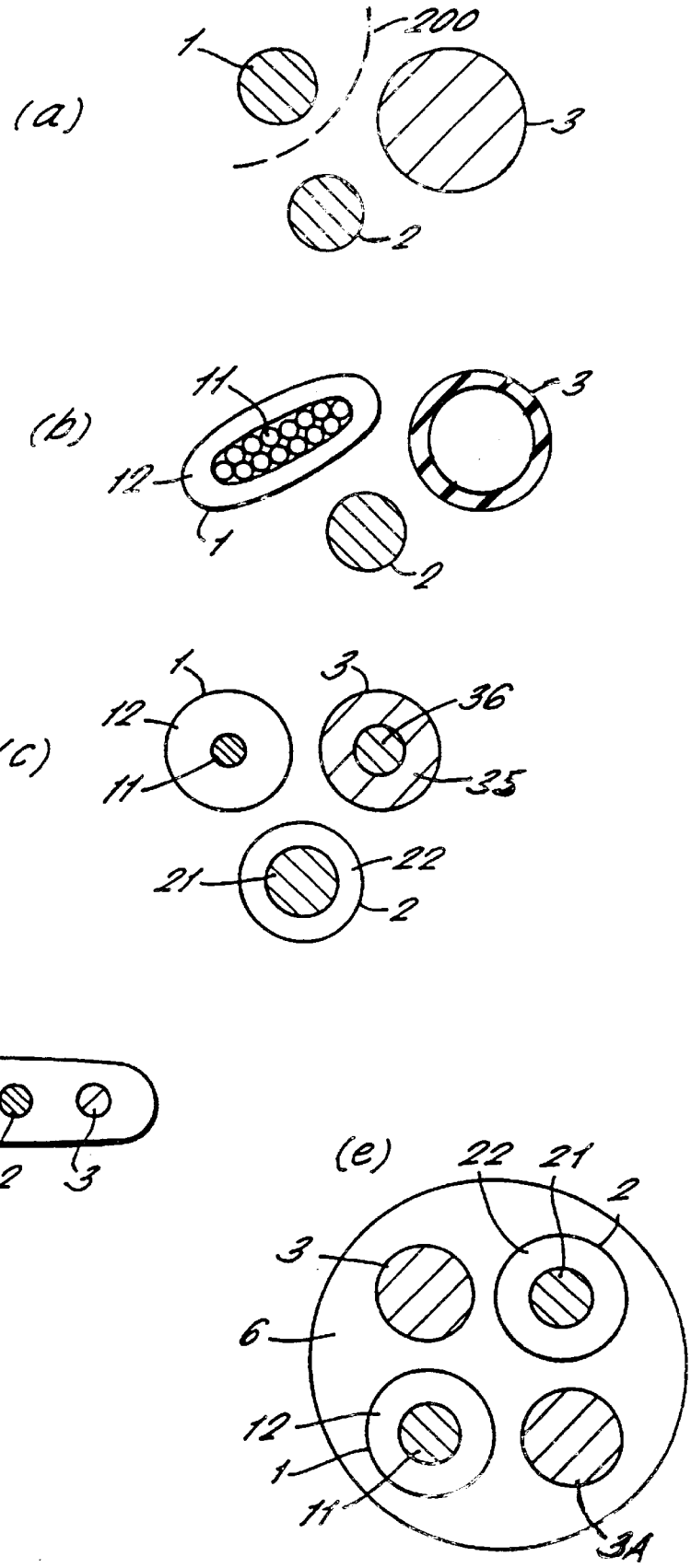
FIG. 5 is a schematic diagram of the cross sections of various embodiments of present invention.

Referring now to FIG. 5, cross sections are shown of braided cables in accordance with embodiments of the present invention. FIG. 5(*a*) is a schematic diagram showing substantially round bare conductive strands 1,2 (i.e. with no integral insulation) and a non-conductive strand 3 of larger diameter. Separate insulation 200 is provided to insulate the conductive strands from each other.

In the embodiment shown in FIG. 5(*b*), the second conductive strand 2 is a bare conductor and the first conductive strand comprises a conductive core of copper filaments 11 inside a dielectric sheath 12. The third strand 3 can be hollow, as shown.

FIG. 5(*c*) shows the cross section of an embodiment of the present invention in which all three strands have substantially the same outer diameter. However the conductive cores 11, 21 of the first and second conductive strands 1, 2 have different diameters, i.e. the cross sectional areas of the conductive components of these two strands are different. The non-conductive strand 3 is a composite of two dielectric materials 35, 36.

FIG. 5(*d*) shows the cross section of a substantially flat or ribbon like cable in which the first and second conductive strands 1, 2 are bare conductors, and all three strands 1, 2, 3 are encased in a flexible dielectric jacket 6.

The braided cable whose cross section is shown in FIG. 5(*e*) comprises two conductive strands 1, 2 braided together with two non-conductive strands 3, 3A. The conductive strands are insulated wires with conductive cores 11, 21 and dielectric sheaths 12, 22 and have a larger diameter than the non-conductive strands 3, 4. All four strands are encased in a flexible dielectric jacket 6.

Figure 6:
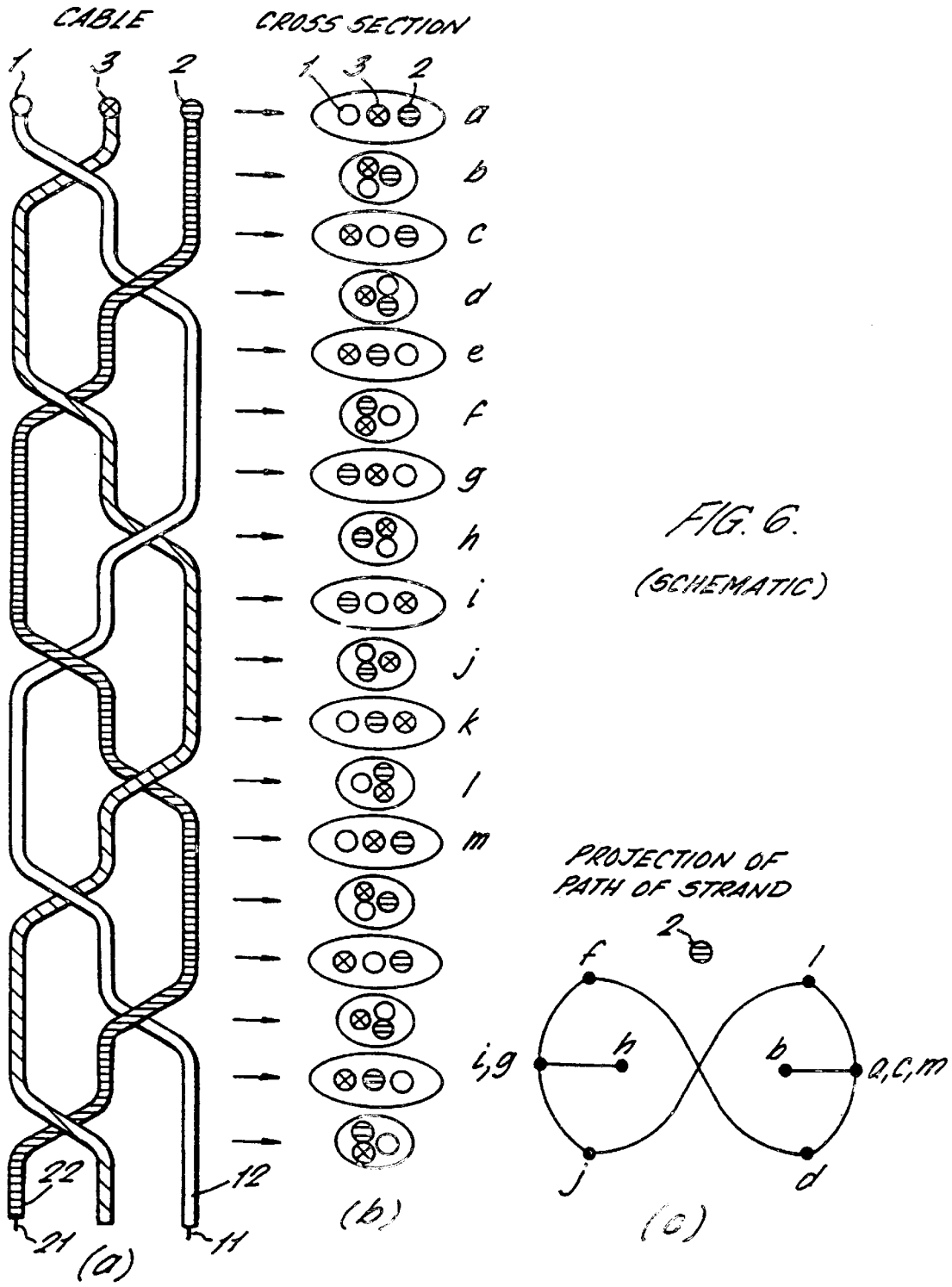
FIG. 6 is a schematic diagram of an embodiment of the present invention comprising three braided strands.

Referring now to FIG. 6(*a*) an embodiment of the present invention comprises three braided strands, two of which are conductive 1, 2 and the other of which 3 is non-conductive. The conductive strands 1, 2 each comprise insulated wires with conductive cores 11, 21 inside outer dielectric sheaths 12, 22. The non conductive strand 3 is comprised entirely of dielectric material. In this example, the strands are braided together in the standard way, which in the figure shown corresponds to the repetitive transposition of first the left-most strand and the central strand, and then the right-most strand and the central strand. In other words, first the left strand and then the right strand are brought into the centre of the cable. When an outer strand is transposed with the central strand, the outer strand is always passed over the central strand in this example.

FIG. 6(*b*) shows the relative positions of the three strands in the cross section of the cable at a series of positions a to m along the cable.

FIG. 6(*c*) shows the projection of the path of the second conductive strand 2 on the plane perpendicular to the longitudinal axis of the cable. The positions of strand 2 on this projection at various points along the length of the cable are indicated.

As can be seen, this projection is essentially a figure of eight. The projection of the path of each strand is the same, but the strands are out of phase. Each conductive strand has negligible self inductance.

Although three strands are shown, it will be apparent that in other embodiments a greater number of strands may be braided together. Also, when the term 'braided' is used, it is intended to embrace other forms of intertwining which may also be described as plaiting. In general, the term 'braided' is used to describe a wide variety of geometries resulting from the systematic and repetitive transposition of the component strands along the length of the cable. It is intended to encompass all geometries in which the strands are fully transposed, i e. geometries in which each strand, in coming back to its original position over a transposition interval, passes through all of the positions originally occupied by the other strands at the start of that interval.

Full transposition gives the best noise rejection with regard to fluctuations in the transverse magnetic field. Braiding, rather than twisting, whereby the strands do not follow substantially helical paths along the cable, reduces the self inductance of the individual conductive strands and improves the noise rejection with regard to fluctuations in the longitudinal component of magnetic field.

Looking again at FIG. 6 it will be noted that wherever the conductive strands 1, 2 cross each other it is always the same strand 2 which is "on top".

Figure 7:
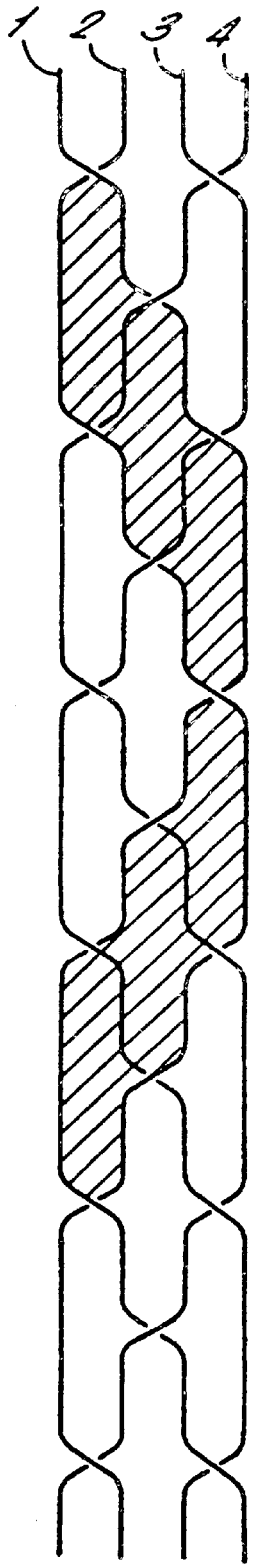
FIG. 7 is a schematic diagram of an embodiment of the present invention comprising four braided strands.
Figure 7:
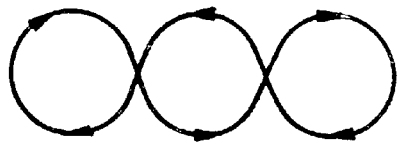

FIG. 7(*a*) shows a schematic diagram of an embodiment in which two conductive strands 1, 2 are braided with two non-conductive strands 3, 4. The shaded areas on this figure show adjacent loops of the circuit comprising the two conductive wires 1, 2. Uniform magnetic flux perpendicular to the plane of the page and passing through these equal areas will link the surface bounded by the conductive strands in opposite directions.

FIG. 7(*b*) shows a projection of the paths of the strands onto a plane perpendicular to the longitudinal axis of the cable. This projection is tri-lobar, and the self inductances of the individual conductive strands are lower than those of an equivalent twisted pair (with the same transposition interval).

Figure 8:
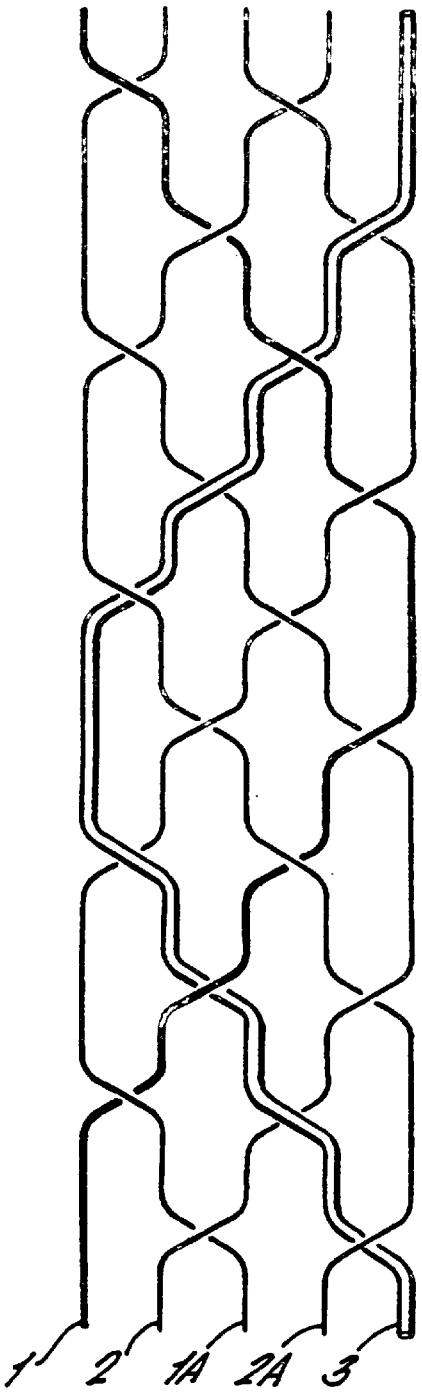
FIG. 8 is a schematic diagram of an embodiment of the present invention comprising five braided strands.
Figure 8:
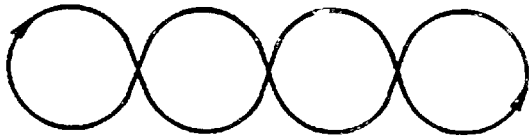

In FIG. 8(*a*) a further embodiment is shown in which four conductive strands 1, 2, 1A, 2A are braided together with a single non-conductive strand 3. Such a cable may be used in audio applications, for example, to carry signals corresponding to two separate channels.

Again, the projection of the paths of the strands is shown (FIG. 8(*b*)) which in this example has four equal lobes. Thus the self inductance of each conductive strand is essentially zero.

Figures 9, 9A:
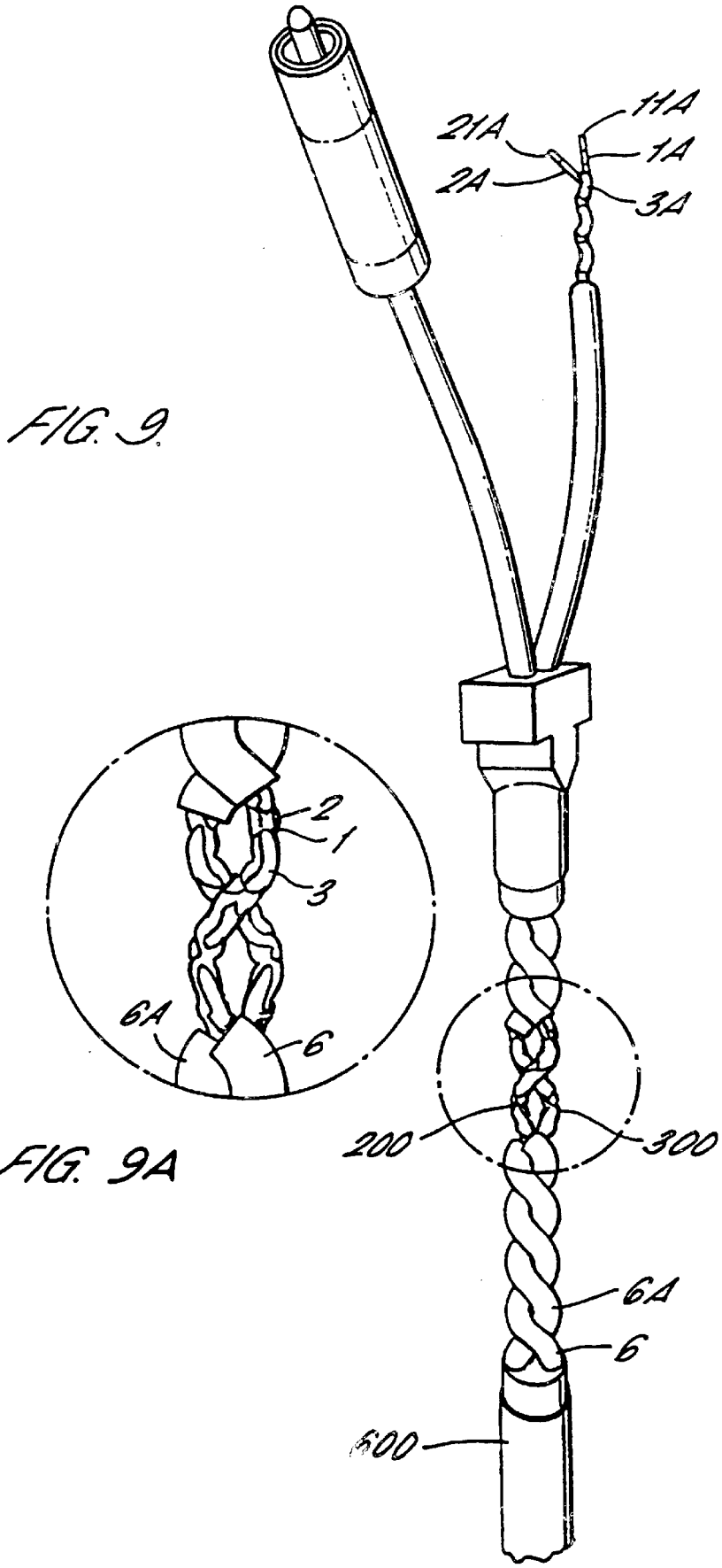
FIG. 9 is a schematic diagram of an audio cable in accordance with an embodiment of the present invention.
FIG. 9A is an enlarged view of the circled section of FIG. 9.
Figure 10:
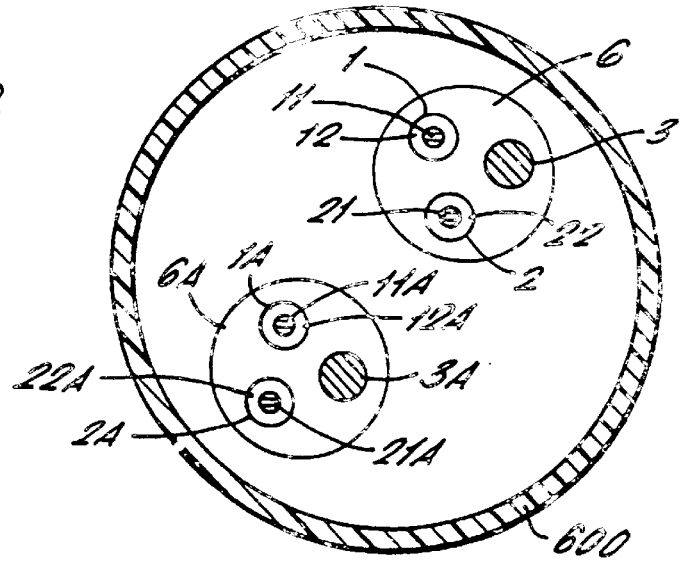
FIG. 10 is a schematic diagram of the cross section of the audio cable shown in FIG. 9.
Figure 10:
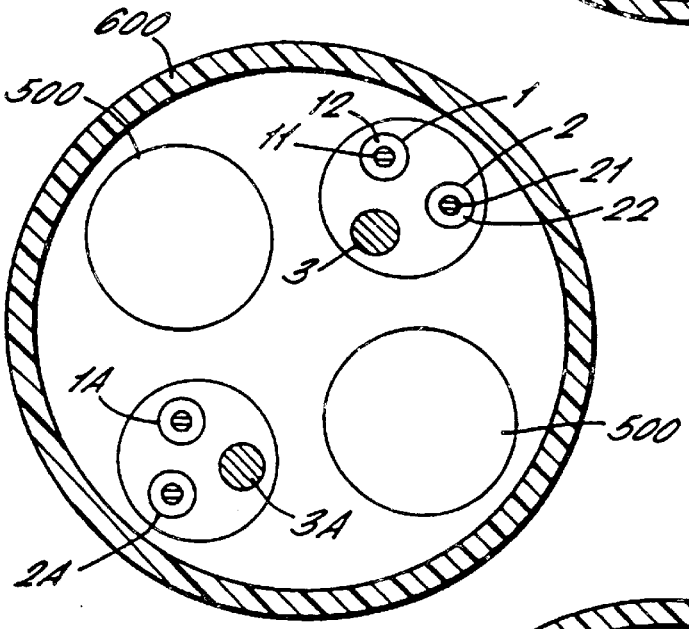

FIG. 9 shows an audio interconnect cable in accordance with the present invention. A cable of similar geometry may also be used to connect the amplifier of an audio system to a loudspeaker. A schematic diagram of the cross section of this cable is shown in FIG. 10. This cable comprises two groups of braided strands 200, 300, each group comprising two conductive strands 1, 2, 1A, 2A braided with a non conductive strand 3, 3A. The conductive strands are jacketed wires with conductive cores 11, 21, 11A, 21A and dielectric sheaths 12, 22, 12A, 22A. Thus in each group, the two conductors are insulated in their own dielectrics and are plaited with a dielectric strand 3, 3A without a conductor running through it (and it shall be referred to as a "dummy core"). The dummy core can be of the same material as a dielectric used on the two conductive strands or of a different material. For example the two conductors can be extruded with a teflon™ dielectric and braided with polyethylene (PE) or polyvinyl chloride (PVC) dummy cores or vice versa, and different characteristics of the cable can be achieved. Any combination of insulating material can be used to achieve the desired cable performance. Higher capacitance materials can be chosen for the non conductive strands 3, 3A (the dummy cores) than would be acceptable in a twisted pair arrangement. This is because the braided geometry results in the cable having a reduced inductance per unit length.

In each group, the three braided strands are encased in a flexible dielectric jacket 6, 6A and the two groups are twisted together with strands of filler (not shown) along the length of the cable. The filler may comprise strands of cotton, although of course other filler materials may be used. The filler provides the advantage that it dampens down any unwanted mechanical vibration of the signal carrying wires within the cable. Finally, the cable comprises an outer sheath or wrap 600 which seals the cable and prevents unravelling of the component strands.

The geometry of the cable shown in FIGS. 9 and 10 produces excellent noise rejection properties, without the use of additional screening foils or braids. This allows a cheaper construction to employed over longer lengths than conventionally screened cable. Of course if foils or screens are used in conjunction with this geometry, then the noise rejection of the resulting cable can be improved even more.

each group the conductive wires are twisted together with two non-conductive strands 3, 3A. In both cables the non-conductive strands are formed from PE. The same wires have been used to make both cables A and B, the wires comprising a conductive core 11, 21, 11A, 21A of seven strands of standard purity copper (SPC) inside an insulating sheath 12, 22, 12A, 22A of teflon™. In each cable the groups of wires have been encased in an inner jacket of PVC 6, 6A and the cable has an outer jacket 600, also of PVC.

TABLE 1

| Model No | | Specification | | | |
|---|---|---|---|---|---|
| Ixos 1002 | A | [(7/0.127 × 2c + PEx1c) × 2 + Cotton filler + Paper] × 1c | | | Dummy Core Platted |
| | B | [(7/0.127 × 2c + PEx2c) × 2 + Cotton filler + Paper] × 1c | | | Twisted |
| | | Construction | | | |
| Conductor | | Material | SPC | | |
| | | Size | .088 mm | | |
| | | Strands | 7/.127 | | |
| | | Diameter | .38 mm | | |
| Insulator | | | Teflon | | |
| | | Thickness | .26 mm | | |
| | | Diameter | .9 mm | | |
| Inner Jacket | | Material | PVC | | |
| | | Diameter | 3.65–3.8 mm | | |
| Outer Jacket | | Material | PVC | | |
| | | Diameter | 10 mm | | |
| | | Characteristics | | | |
| A | Braided with Dummy Core | | | | |
| | | Ohm/M at 20° C. | Capacitance PF/M | Inductance uHm at 1 Khz | Attenuation db/100 m at 20 Khz |
| | Channel | | | | |
| | Left | 0.23 | 37.35 | 0.886 | 11.05 |
| | Right | 0.23 | 37.62 | 0.896 | 11.05 |
| B | Twisted Pair | | | | |
| | Channel | | | | |
| | Left | 0.23 | 30.87 | 1.035 | 11.27 |
| | Right | 0.23 | 30.63 | 1.023 | 11.27 |

(A) Braided dummy core, retains the same resistance as the (B) Twisted Pair, and the capacitance remains very low, (less than 100 PF/m). The inductance improves significantly, dropping from a mean of 1.03 uH/M at 1 khz to a mean of .89 uH/M at 1 khz. An improvement of over 13%.

Test Equipment:

| | |
|---|---|
| Hewlett Packard HP 4284A | Precision LCR Meter 20 Hz - 1 Mhz |
| Anristu MS 3401A | Network analyser, 10 Hz–30 Mhz |

Braiding the conductive strands enables a greater degree of crossover of the signal carrying conductive strands to be achieved without them bunching in production (the elastic band effect).

This geometry also allows the cable designer to have a greater level of control over the LCR properties of the finished design, by using different insulating materials, thereby giving a more flexible stage from which to design the sound of the cable. In audio use this translates to having a greater degree of control over the signal phasing. In power use a greater degree of flexibility over the current flow is achieved.

Figure 11:
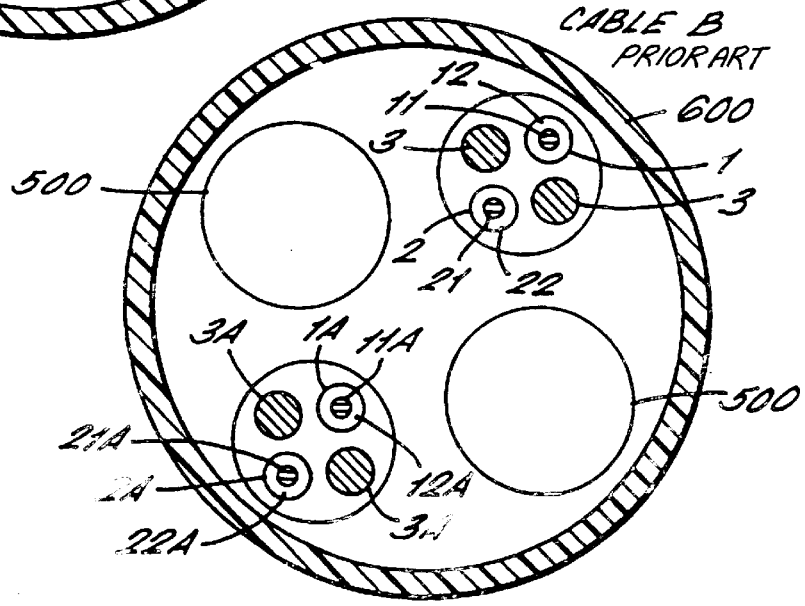
FIG. 11 is a schematic diagram of the cross sections of the cables whose performance characteristics are given in Table 1 of the description.

Table 1, below, shows a comparison of the performance of two cables, one in accordance with the present invention and the other with the prior art. Cross sections of cables A and B referred to in this table are shown in FIG. 11.

Both cables have substantially the same geometry as the cable shown in FIG. 8, i.e. they each comprise two groups of strands twisted together with cotton filler. However, looking at FIG. 11 it can be seen that in cable A each group comprises two wires 1, 2, 1A, 2A braided together with a non-conductive strand 3, 3A, whereas in cable B, within In each cable the crossover frequency of the conductive strands 1, 2, 1A, 2A is approximately five per inch, and, as such, cable B is approaching the limit of twisted pair technology for audio interconnects, i.e. it gives close to the best possible noise rejection achievable with twisted wires, because any further increase in crossover frequency would lead to unacceptable bunching. Of course, in other embodiments of the present invention, the crossover frequency of the conductive strands may be greater than five per inch.

As can be seen from Table 1, the performance of cable A (i.e. the cable in accordance with the present invention) is significantly better than that of cable B. The resistance per unit length of the two cables is the same but the inductance per unit length of the braided cable is significantly lower. Importantly the attenuation of the braided cable is also significantly lower than that of the conventional twisted pair arrangement.

Table 2, below, shows a comparison of the performance of braided and conventional cables comprising heavier gauge wire. Cross sections of cables A and B referred to in this table are shown in FIG. 12. Cable A of Table 2 comprises two electrically conductive wires 1, 2 braided together with a non-conductive strand 3 of PE. No outer jacket is used; the braided geometry prevents unravelling, and the cable holds itself together. Cable B comprises two parallel wires 1, 2 (i.e. not twisted) connected by a central link, or spacer, 900.

TABLE 2

| Model No | | Specification | |
|---|---|---|---|
| Ixos 6002 | A | (338/.10 × 2 + PE × 1C) | Braided Pair |
| Ixos 603 | B | 338/.10 × 2 | Parallel Pair |

Construction

| | | Braided Pair | Parallel Pair |
|---|---|---|---|
| Conductor | Material | OFC | OFC |
| | Size | 2.64 | 2.64 |
| | Strands | 336 × .10 | 338 × .10 |
| | Diameter | 2.40 | 2.40 |
| Insulator | | | |
| | Thickness | 0.40 | 0.40 |
| | Diameter | 3.20 | 3.2 |
| Dummy core | Material | PE | n/a |
| | Diameter | 3.20 | n/a |
| Outer Jacket | Material | n/a | PVC |

Characteristics

Braided with Dummy Core

| | | Ohm/M at 20° C. | Capacitance PF/M | Inductance uHm at 1 Khz | Attenuation db/100 m at 20 Khz |
|---|---|---|---|---|---|
| A | Channel | | | | |
| | Left | 0.0081 | 41.95 | 0.675 | 3.82 |
| | Right | 0.0081 | 41.95 | 0.675 | 3.82 |
| B | Twisted Pair Channel | | | | |
| | Left | 0.0081 | 23.46 | 0.874 | 12.44 |
| | Right | 0.0081 | 23.46 | 0.874 | 12.44 |

Test Equipment:
Hewlett Packard HP 4284A Precision LCR Meter 20 Hz - 1 Mhz
Anristu MS 3401A Network analyser, 10 Hz–30 Mhz In each of cables A and B the wires comprise conductive cores 11, 12 of 336 strands of OFC (oxygen-free copper) inside an insulating sheath 12, 22 of PVC. The overall diameter of the conductive cores of these wires is 2.4 mm. These cables, for example, would be suitable for use as speaker cables.

In cable B, the sheaths 12, 22 of the two wires 1, 2 and the spacer 900 are integral, having been formed by extrusion. Cable B is a parallel extruded-jacket pair.

Looking now at the performance characteristics in Table 2, the resistances per unit length of the two cables are the same. The capacitance per unit length of the braided cable A, although greater than that of the conventional pair B, is still low, and the inductance per unit length of the braided cable is significantly reduced.

Referring now to FIG. 13, a further embodiment of the present invention comprises screening means. This embodiment comprises two conductive strands 1, 2 braided together with a non-conductive strand 3 and encased in a flexible dielectric jacket 6. Surrounding the braided strands is a closely woven pure silver-plated OFC braid 700 to provide screening over an extremely wide band width. More than one screening braid may be employed.

It will be apparent that other shielding means may be incorporated in addition to or as alternatives to a metallic braid. Other shielding means include conductive PVC carbon sheaths, metallic/conductive PVC jackets, and Mylar-backed aluminium foil wraps.

Figure 14:
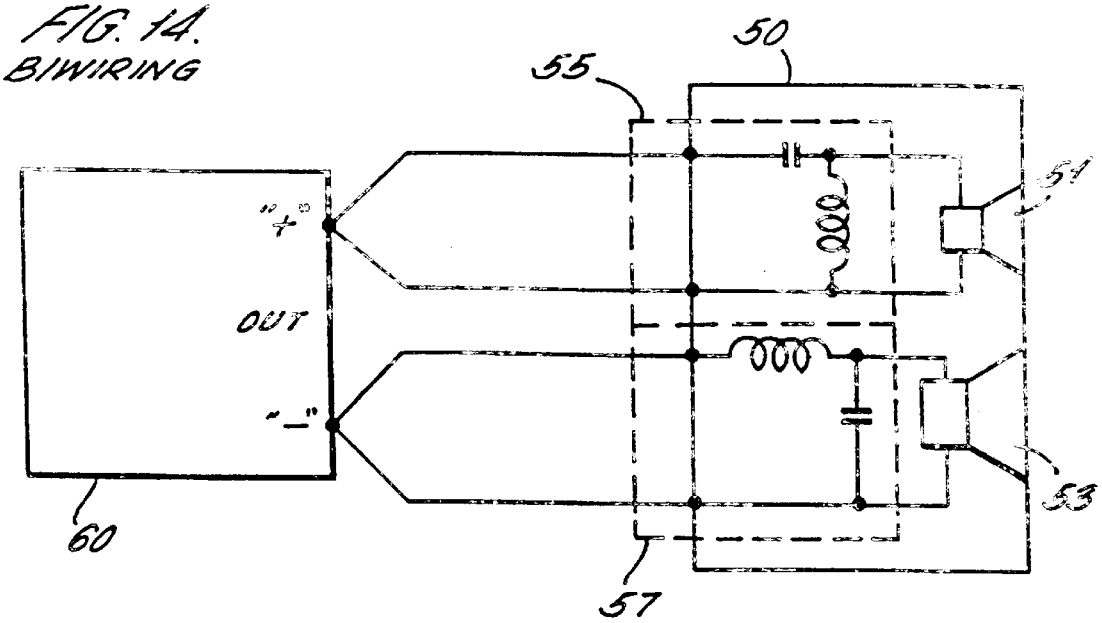
FIG. 14 is a schematic diagram of a loudspeaker biwired to an amplifier.

Certain embodiments of the present invention are directed to the provision of cables for "biwiring" loudspeakers. Biwiring is the practice of separately connecting the low frequency (woofer) and high frequency (tweeter) sections of the loudspeaker to the same amplifier output, usually by means of separate cables. A schematic diagram of a loudspeaker 50 biwired to an amplifier 60 is shown in FIG. 14. The "crossover" circuits 55, 57 connecting the loudspeaker inputs to the respective cones 51, 53 are shown greatly simplified. The high frequency (HF) section is incorporates a high-pass filter 55, and the low frequency (LF) section incorporates a low-pass filter crossover circuit 57.

Clearly, in this arrangement, rather than using conventional cables, two cables embodying the present invention and each comprising two conductive strands braided together with a non-conductive strand could be used to biwire the speaker unit to the amplifier, and would provide the advantages discussed above An alternative is to use a single cable in accordance with the first aspect of the present invention comprising four conductive strands braided together with at least one non-conductive strand. Two of the four conductive strands would then be used as the "go" and "return" wires to the tweeter 51, and the remaining 2 strands would be connected to the woofer 53. By using a single cable, the biwiring of the speaker unit is simplified and made neater.

In general, larger currents are required to drive the LF section than the HF section, and it is therefore desirable that the conductive cross sections of the go and return paths to the LF section be larger than these to the HF section.

In a single cable, this can be achieved by braiding together conductive strands having different conductive cross sections. If the overall cross sections of the component strands are substantially different however, this can cause handling problems, during cable manufacture, and also can result in a non-uniformity of cross section and mechanical characteristics along the cable's length.

One solution to this problem is to employ conductive strands which have different conductive cross sections but the same overall cross sections e.g. round wires having the same overall diameter but with different diameter copper cores surrounded by different thicknesses of insulation.

Another solution is to employ a cable comprising a large number of substantially identical conductive strands braided together with at least one non-conductive strand, and to connect the high and low frequency sections of the loudspeaker to the amplifier using respective groups of different numbers of these conductive strands in electrical parallel. For example, with a cable comprising six conductive strands, two conductive strands could be used for each of the go and return paths to the LF section leaving two strands for connection to the HF section. Thus the conductive cross section to the "woofer" would be double that to the "tweeter". By using different cables and groups of different numbers of strands, a wide variety of cross section ratios can be achieved. Also, the go and return paths to a particular section of the loudspeaker need not have the same conductive cross section.

A cross section of a different embodiment suitable for biwiring is shown in FIG. 15. This cable has an inner section 70 comprising two conductive strands 1, 2 braided together with a non-conductive strand 3. In this example the conductive strands are heavy guage round insulated wires having the same diameter as the non conductive strand, which is formed from dielectric material. This inner section 70 provides the go and return paths to the LF loudspeaker section. An outer section 71 surrounds the inner section 70 and comprises a further two conductive strands 1A, 2A braided together with a further non-conductive strand 3A. Thus the outer section 71 forms a braided layer over the braided inner core 70. The three strands of the outer section, or layer, are braided together and around the core. The conductive strands of the outer layer in this example are round wires of smaller guage than these in the inner section (ie they have smaller conductive cross section) and are intended to provide the go and return signal paths to the HF section of the loudspeaker.

Advantages of this arrangement include:

1) The two groups of wires to the HF & LF speaker sections (ie the wires of the inner section and the outer section) are separately braided. Each group is therefore individually arranged for improved noise rejection.

2) By braiding the inner and outer sections separately, each has reduced self inductance, and mutual inductance is also reduced. This reduces cross over interaction between the LF and HP sections, whilst providing the advantage that only one cable is needed to the loudspeaker. This geometry could of course be used to carry signals from separate sources, and would reduce interaction between those signals.

3) By braiding the smaller wires 1A, 2A, 3A, for connection to the "tweeter", around the LF wires 1A, 2A, 3A, the mean separation of the smaller wires is increased, so reducing the interaction between "go" and "return" HF currents, (i.e. the proximity effect). This is particularly advantageous for the HF wires as the proximity effect which results in increased resistance is more pronounced at higher frequencies.

4) This geometry facilitates the provision of different conductive cross sections to different speaker sections. Only two wires need be connected to the inputs to each section; there is no need to connect different numbers of similar strands in parallel to obtain different cross sections.

5) The cable has substantially uniform flexibility (ie exhibits the same flexibility in all directions away from its longitudinal axis) so facilitating cable laying. The cable is mechanically dead, i.e. has no preferred direction of flex, and no tendency to bend in any particular direction of its own accord.

6) The cable has substantially circular overall cross section, which facilitates cable handling and spooling.

7) Each section comprises just three braided strands which facilitates manufacture, for example when compared with other embodiments in which greater numbers of strands are braided together. In the present embodiment the outer layer can be braided at substantially the same time as the inner section, or can be added at a later stage of the cable manufacture.

In other embodiments comprising a braided inner section surrounded by a braided outer layer, the inner and outer sections may comprise different numbers of strands and may comprise more than three strands.

Such an embodiment is shown in FIG. 16. In this example the inner section 70 again comprises three braided strands, two of which are heavy guage round insulated wires 1, 2, but the outer section comprises sixteen strands. Of these sixteen, eight are conductive 1A (smaller guage round insulated wires) and eight are non-conductive 3A. This cable could be used to biwire loudspeakers, four of the outer layer's eight conductive strands being connected together at the respective amplifier output and tweeter input terminals to provide the "go" signal path, and similarly four for the return path.

Although connection is this made slightly more difficult, this arrangement provides the advantages that:

1) Increasing the number of strands in the outer layer makes it more self supporting (and inhibits strand movement or vibration) and provides a more uniform, substantially circular outer "sheath". This further improves the mechanical characteristics and "feel" of the cable, whilst retaining uniform flexibility.

2) The overall conductive cross section required for the HF speaker section can be divided amongst a plurality of small diameter wires. This helps prevent increases in the resistance of the HF signal path at high frequencies due to the skin effect. The smaller the diameter of the conductive core of each outer layer wire, the smaller the increase in resistance with frequency due to the skin effect.

Figure 17:
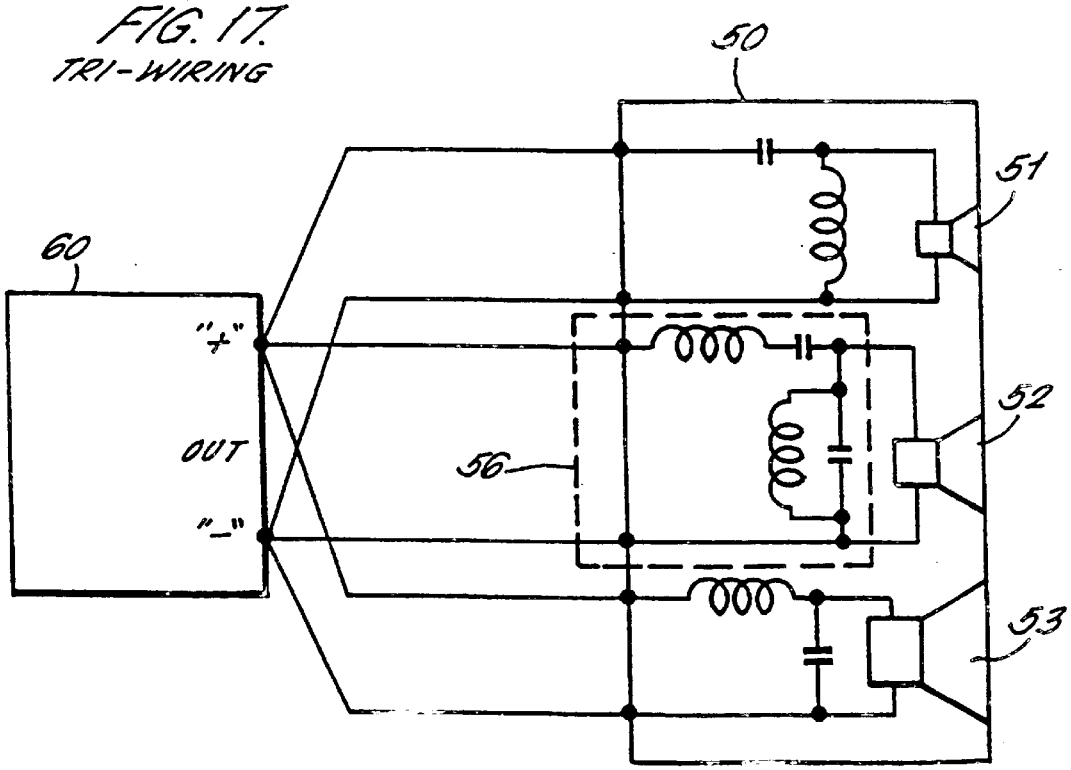
FIG. 17 is a schematic diagram of a loudspeaker triwired to an amplifier.

The cable of FIG. 16 could also be used for the "tri-wiring" of loudspeakers. A schematic diagram of a triwired speaker is shown in FIG. 17, and again the crossover circuits (shown as high pass, band pass 56, and low pass filters respectively for the HF, medium frequency (MF), and LF sections) are greatly simplified.

Using the cable of FIG. 16, for this triwiring the two heavier guage wires of the inner section may be connected to the LF inputs, two of the outer layer's wires may provide connection to the HF inputs, and the remaining six outer layer wires may be connected in two groups of three as the "go" and "return" paths to the MF section. In this way, signal paths of different conductive cross sections may be provided to different speaker sections, according to the signal currents in each.

Further embodiments comprise a plurality of substantially concentric braided layers around an inner section which may for example comprise dielectric material, may be hollow, or may comprise at least three braided strands.

FIG. 18 shows a schematic cross section of one such cable. In this example the inner section 70 consists of four strands braided together, two of which are conductive 1, 2 and two are non-conductive 3. Immediately surrounding this inner "core" 70 is a first layer 71 comprising three conductive 1A and three non-conductive 3A strands all braided together, and outside this is a second layer 72 comprising eight braided strands (four conductive 1B, four non-conductive 3B). This cable could be used to triwire a loudspeaker, each layer or section being used to connect a respective speaker section, or could be used to carry signals from separate sources. For a desired number of twenty-five conductive strands in a cable, the first layer can have nine conductive strands and nine non-conductive strands and second layer 72 can have fourteen conductive strands 1B and fourteen non-conductive strands around the core 70 of two conductive and two non-conductive strands.

For a desired number of twenty five conductive strands in a cable, the first layer can have nine conductive strands and nine non-conductive strands, and the second layer 72 can have fourteen conductive strands 1*b* and fourteen non-conductive strands around the core 70 formed of two conductive and two non-conductive strands In all of the above examples comprising a braided inner section surrounded by one or more braided layers, the strands could of course be self supporting or alternatively could be encased in a jacket of one or more suitable materials.

Figure 19:
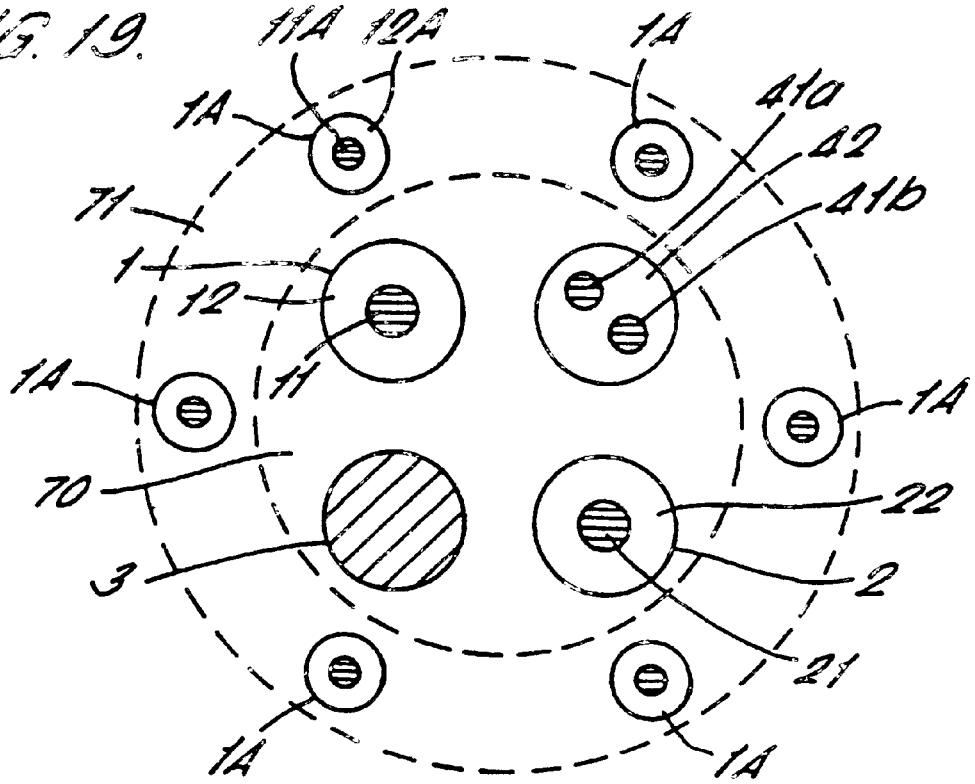
FIG. 19 is a schematic cross section of an embodiment comprising a conductive strand having two conductive cores.

FIG. 19 shows a further embodiment of the present invention, in which the outer layer 71 comprises just conductive strands 1A with conductive cores 11A.

In this example the inner section 70 comprises three conductive strands 1, 2, 4 and one non-conductive strand 3. Two of the conductive strands have single conductive cores 11, 21 and the remaining one has two conductive cores 41*a*, 41*b* electrically insulated from each other by a dielectric jacket 42. The conductive strands 1, 2 having single cores 11, 21 are braided together with the non-conductive strand 3, but not with the two-cored strand 4. Of course, in other examples, all of the strands may be braided together.

The two cores of the third conductive strand 4 are in the form of a substantially parallel pair, but in other examples may be twisted. It will be apparent that in yet further embodiments, the third conductive strand may comprise co-axial conductors.

The two conductive strands 1, 2 having single conductive cores may be used to carry one differential signal, and exhibit (owing to their braided geometry) low inductance and improved noise rejection as discussed above.

The third conductive strand 4 comprising two cores may be used to carry a second differential signal.

Figure 20:
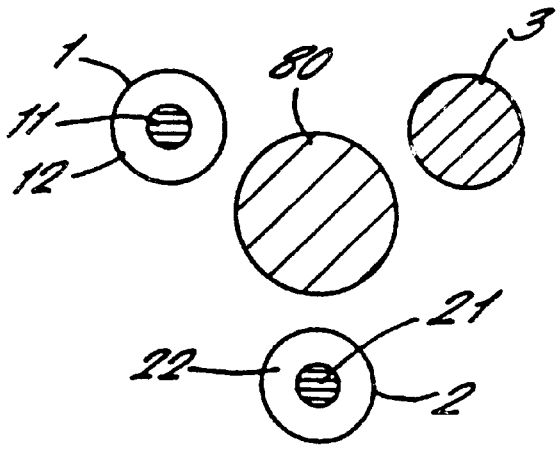
FIG. 20 is a schematic cross section of a further embodiment.

FIG. 20 shows a schematic cross section of a further embodiment comprising two conductive strands 1, 2 and a non-conductive strand 3 braided together around a central "core" 80. In this example the central core 80 is a flexible dielectric strand but in other embodiments the core may, for example, be hollow and/or comprise conductive strands.

It will be apparent that in embodiments of the present invention the non-conductive strand or strands may be hollow. Such a strand or strands could provide the advantage of damping vibrations of the conductive strands within the cable.

It will also be apparent that all of the variations discussed above regarding the materials, geometry and sizes of the conductive and non-conductive strands, and variations regarding the provision of any jackets, casings, screens or shields, are equally applicable to all embodiments, whether individually or in combination.

Although specific embodiments have been described with reference to audio and computer applications, it will be apparent that cables in accordance with the present invention are not limited to these applications, and may be used in a wide range of signal transmission applications, including the transmission of video signals, and low noise voltage measurement.

What is claimed is:

1. An electrical cable comprising a first strand, a second strand, and a third strand, wherein said first and second strands are electrically conductive and electrically insulated from each other, said third strand is electrically non-conductive, and said first, second and third strands are braided together, such that the position of each conductive strand in the cable cross section varies along the cable and the projection of the position on the cross section follows a path which crosses itself at least once and comprises at least two loops, the path generally defining at least one figure of eight form.

2. An electrical cable in accordance with claim 1 wherein said first, second, and third strands are encased in a flexible jacket of dielectric material.

3. An electrical cable in accordance with claim 2 wherein said jacket comprises at least one of the materials from a list including: PTFE; PE; and PVC.

4. An electrical cable in accordance with claim 2, wherein said third strand and said flexible jacket comprise the same dielectric material.

5. An electrical cable in accordance with claim 4, wherein said third strand and said flexible jacket are indistinguishable.

6. An electrical cable in accordance with claim 1, wherein said third strand is comprised wholly of dielectric material.

7. An electrical cable in accordance with claim 1, wherein said third strand comprises at least one of the materials from a list including: PTFE; PE; and PVC.

8. An electrical cable in accordance with claim 1, wherein said third strand has a substantially circular cross section.

9. An electrical cable in accordance with claim 1 wherein at least one of said first and second strands comprises a single conductive filament.

10. An electrical cable in accordance with claim 9, wherein said filament comprises at least one of the materials from a list including: copper; oxygen-free copper; silver; conductive carbon fibre; and gold.

11. An electrical cable in accordance with claim 9, wherein said filament has a coating of silver or gold.

12. An electrical cable in accordance with claim 1 wherein at least one of said first and second strands comprises a plurality of conductive filaments.

13. An electrical cable in accordance with claim 12, wherein said filaments comprise at least one of the materials from a list including: copper, oxygen-free copper; silver; conductive carbon fibre; and gold.

14. An electrical cable in accordance with claim 12, wherein said filaments have coatings of silver or gold.

15. An electrical cable in accordance with claim 12 wherein said filaments are twisted together.

16. An electrical cable in accordance with claim 1 wherein at least one of said first and second strands comprises a conductive core inside a sheath of dielectric material.

17. An electrical cable in accordance with claim 16, wherein said sheath comprises at least one of the materials from a list including: PTFE; PE; and PVC.

18. An electrical cable in accordance with claim 1 wherein at least one of said first and second strands is a round wire.

19. An electrical cable in accordance with claim 1 wherein said first and second strands have substantially the same overall cross sectional areas.

20. An electrical cable in accordance with claim 1 wherein said first and second strands have substantially different cross sectional areas.

21. An electrical cable in accordance with claim 1 wherein said first and second strands comprise conductive cores of substantially the same cross sectional areas.

22. An electrical cable in accordance with claim 1, wherein said first and second strands comprise conductive cores of substantially different cross sectional areas.

23. An electrical cable in accordance with claim 1 wherein said first strand and said third strand have substantially the same overall cross sectional areas.

24. An electrical cable in accordance with claim 1, wherein said third strand has a larger overall cross sectional area than said first strand.

25. An electrical cable in accordance with claim 1, wherein said third strand has a smaller overall cross sectional area than said first strand.

26. An electrical cable in accordance with claim 1 further comprising a fourth strand, a fifth strand, and a sixth strand, wherein said fourth and fifth strands are electrically conductive and electrically insulated from each other, said sixth strand is electrically non-conductive, and said fourth, fifth and sixth strands are braided together.

27. An electrical cable in accordance with claim 26 wherein said fourth, fifth and sixth strands are substantially the same as said first, second and third strands respectively.

28. An electrical cable in accordance with claim 26 wherein said first, second and third strands comprise a first group and said fourth, fifth and sixth strands comprise a second group, wherein said first group and said second group are twisted together.

29. An electrical cable in accordance with claim 28 wherein said first and second groups are twisted together with at least one strand of filler means.

30. An electrical cable in accordance with claim 1 further comprising an outer sheath of dielectric material.

31. An electrical cable in accordance with claim 1 further comprising screening means arranged to screen the conductive strands from at least a fraction of incident electromagnetic radiation.

32. An electrical cable in accordance with claim 1 comprising at least three strands braided together, said at least three strands including said first, second and third strands.

33. An electrical cable in accordance with claim 32 comprising four strands braided together, said four strands including said first, second and third strands, and a further electrically non-conductive strand.

34. An electrical cable in accordance with claim 32 comprising five strands braided together, wherein four of the said five strands are electrically conductive and electrically insulated from each other, and include said first and second strands, and one of said five strands is said third strand.

35. An electrical cable in accordance with claim 32 comprising eight strands braided together, wherein four of said eight strands are electrically conductive and electrically insulated from each other and include said first and second strands, and four of said eight strands are electrically non-conductive and include said third strand.

36. An electrical cable in accordance with claim 32 comprising sixteen strands braided together, wherein eight of said sixteen strands are electrically conductive and include said first and second strands, and eight of said sixteen strands are electrically non-conductive and include said third strand.

37. An electrical cable in accordance with claim 32, wherein said electrically conductive strands are round wires comprising conductive cores inside dielectric sheaths.

38. An electrical cable in accordance with claim 1, comprising twenty-five conductive strands, said twenty-five conductive strands including said first and second strands.

39. An electrical cable in accordance with claim 1, wherein said electrical cable is substantially ribbon-like.

40. An electrical cable in accordance with claim 1, wherein the crossover frequency of said first and second strands is in the range 1 to 1000 per meter.

41. An electrical cable in accordance with claim 1, wherein said third strand is hollow.

42. An electrical cable in accordance with claim 1, wherein at least one of said electrically conductive strands comprises at least two electrically conductive cores, said cores being electrically insulated from each other.

43. An electrical cable comprising:

an inner section comprising an electrical cable in accordance with claim 1; and an outer section comprising at least three strands braided together over said inner section, whereby the strands of said outer section form a braided sleeve over said inner section, and the strands of said outer section are not braided together with the strands of said inner section.

44. An electrical cable in accordance with claim 43, wherein at least two of said at least three strands of said outer section are electrically conductive.

45. An electrical cable in accordance with claim 44, wherein said outer section comprises eight strands, including said at least three strands, braided together over said inner section, said eight strands comprising four electrically conductive strands electrically insulated from one another.

46. An electrical cable in accordance with claim 45, wherein said outer section comprises sixteen strands, including said at least three strands, braided together over said inner section, said sixteen strands comprising eight electrically conductive strands electrically insulated from one another.

47. An electrical cable in accordance with claim 43, wherein said outer section comprises electrically conductive strands having smaller conductive cross sectional areas than the electrically conductive strands of said inner section.

48. An electrical cable comprising:

an inner section comprising an electrical cable in accordance with claim 1; and a plurality of layers, each layer comprising at least three strands braided together and over said inner section and any layer or layers beneath, whereby said layers form a plurality of nested braided sleeves over said inner section, and the strands of any one said layer are not braided together with the strands of any other said layer or said inner section.

49. An electrical cable in accordance with claim 48, wherein said at least three strands of at least one of said plurality of layers comprise at least two electrically conductive strands electrically insulated from each other.

50. Electrical apparatus comprising a first electrical device and a second electrical device, wherein said first and second electrical devices are connected by an electrical cable in accordance with claim 1.

51. Electrical apparatus in accordance with claim 50, wherein at least one of said first and second electrical devices comprises part of a system from a list including: an audio system; a hi-fi system; a video system; and a computer system.

52. Electrical apparatus in accordance with claim 50, wherein said first electrical device is an amplifier.

53. Electrical apparatus in accordance with claim 50, wherein said second electrical device is a loudspeaker.

54. A method of manufacturing an electrical cable comprising the steps of braiding together a first conductive strand, a second conductive strand, and a non-conductive strand such that the position of each conductive strand in the cable cross section varies along the cable and the projection of the position on the cross section follows a path which crosses itself at least once and comprises at least two loops generally defining a figure of eight form, and electrically insulating said first conductive strand from said conductive strand.

55. A method in accordance with claim 54 further comprising the step of forming a jacket of dielectric material around said strands.

* * * * *

UNITED STATES PATENT AND TRADEMARK OFFICE

CERTIFICATE OF CORRECTION

PATENT NO. : 6,388,188 B1
DATED : May 14, 2002
INVENTOR(S) : Ian Harrison

It is certified that error appears in the above-identified patent and that said Letters Patent is hereby corrected as shown below:

Columns 11 and 12,
Table 1, under the heading "Characteristics" Section A for "Braided with Dummy Core", the heading "Inductance uHm at 1 Khz" should read -- Inductance uH/M at 1 Khz --.
Table 1, under the heading "Characteristics" Section B for "Twisted Pair", in the line "Right", under the column heading "Inductance" cancel "1023" and insert -- 1.028 --.
Table 2, under the heading "Specification" for the line for "Model No. Ixos 6002" cancel "(338/.10 x 2 + PE x 1C)" and insert -- (336/.10 x 2 + PE x 1C) --.

Signed and Sealed this

Twenty-ninth Day of July, 2003

JAMES E. ROGAN
*Director of the United States Patent and Trademark Office*